US006226903B1

(12) United States Patent
Erickson

(10) Patent No.: US 6,226,903 B1
(45) Date of Patent: May 8, 2001

(54) ROTATING DISK TYPE DITCHER SYSTEM

(76) Inventor: Edwin A. Erickson, 13946--86th St. SE., Milnor, ND (US) 58060-9750

( * ) Notice: Subject to any disclaimer, the term of this patent is extended or adjusted under 35 U.S.C. 154(b) by 0 days.

(21) Appl. No.: 09/315,743

(22) Filed: May 20, 1999

(51) Int. Cl.[7] ..... E02D 17/13; E02F 5/10
(52) U.S. Cl. ..... 37/366; 172/149
(58) Field of Search ..... 37/366, 367, 380, 37/381; 172/784, 817, 823, 149

(56) References Cited

U.S. PATENT DOCUMENTS

| | | | | |
|---|---|---|---|---|
| 16,007 | * | 11/1856 | Evans | 172/542 |
| 709,601 | * | 9/1902 | Horner | 172/149 |
| 1,095,097 | * | 4/1914 | Fournet | 37/92 |
| 1,175,926 | * | 3/1916 | Bunnell | 37/354 |
| 1,320,285 | * | 10/1919 | Smith | 172/149 |
| 1,627,017 | * | 5/1927 | Dempewolf | 172/149 |
| 2,027,502 | * | 1/1936 | Weismüller | 172/149 |
| 2,453,723 | * | 11/1948 | Palmer et al. | 37/366 |
| 2,662,311 | * | 12/1953 | Chattin | 37/372 |
| 2,784,507 | * | 3/1957 | Kinsinger | 37/366 |
| 2,885,800 | * | 5/1959 | Hawkins | 37/91 |
| 2,923,073 | * | 2/1960 | Baker et al. | 37/92 |
| 2,965,985 | * | 12/1960 | Sillasen et al. | 37/92 |
| 2,987,837 | * | 6/1961 | Rasmussen et al. | 37/366 |
| 2,990,632 | * | 7/1961 | Noblin | 37/366 |
| 3,021,622 | * | 2/1962 | Whittier | 37/366 |
| 3,025,618 | * | 3/1962 | Croucher | 37/354 |
| 3,041,751 | * | 7/1962 | Chattin | 37/366 |
| 3,601,910 | * | 8/1971 | Goltz | 37/98 |
| 3,624,826 | * | 11/1971 | Rogers | 37/92 |
| 3,880,243 | * | 4/1975 | Gurries et al. | 172/784 |
| 5,027,534 | * | 7/1991 | Sackett | 37/91 |
| 5,113,610 | * | 5/1992 | Liebrecht, Jr. | 37/94 |
| 5,237,761 | * | 8/1993 | Nadeau et al. | 37/92 |

FOREIGN PATENT DOCUMENTS

| | | | | |
|---|---|---|---|---|
| 536983 | * | 2/1957 | (CA) | 37/366 |
| 640318 | * | 4/1962 | (CA) | 37/366 |
| 651579 | * | 11/1962 | (CA) | 37/366 |
| 811295 | * | 11/1962 | (DE) | 37/366 |
| 1014975 | * | 8/1952 | (FR) | 37/366 |

* cited by examiner

*Primary Examiner*—Robert E. Pezzuto
*Assistant Examiner*—Arpad Fabian Kovacs
(74) *Attorney, Agent, or Firm*—Michael S. Neustel

(57) ABSTRACT

A ditch digging and cleaning system includes a frame having a hitch and a pair of support arms with wheels, a front blade, a pair of side blades, a dispersing member rotatably attached to the frame, a power train mechanically connected to the dispersing member, and an adjustable deflector assembly attached to the rear portion of the frame. The dispersing member is comprised of a circular base, and a plurality of fan blades orthogonally attached to an upper surface of the circular base. The dispersing member is juxtaposed behind a pan attached to the front blade. The dispersing member is also less than 45 degrees with respect to the ground surface. The blade preferably is V-shaped for penetrating hardened soil. Coulters may be added in front of the front blade for loosening the ground. In operation, the front blade severs the dirt from the ground surface at a desired depth. The dirt is passed over the pan onto the dispersing member where after the fan blades throw the dirt toward the deflector assembly that guides the dirt in the desired location.

20 Claims, 4 Drawing Sheets

ROTATING DISK TYPE DITCHER SYSTEM

BACKGROUND OF THE INVENTION

1. Field of the Invention

The present invention relates generally to ditch diggers and more specifically it relates to a ditch digging and cleaning system for easily digging ditches, cleaning ditches, and creating terraces with reduced power take-off (PTO) power.

Farmers often times desire to dig ditches for draining water from fields thereby increasing the usability of the land. In addition, farmers often times desire to construct terraces on uneven land. Hence, it is desirable to have a single machine that both digs ditches and creates terraces.

2. Description of the Prior Art

Ditch digging devices have been in use for years. Typically, a rotary blade member is utilized that has a rotational plane parallel to a vertical axis. The lower edge of a rotary blade engages, cuts and throws the dirt creating a curved ditch structure.

Conventional ditch diggers require significant PTO power to the PTO shaft since the rotary blade is initially engaging, cutting and throwing the dirt. In addition, conventional ditch diggers merely cutout a curved ditch that easily fills in with dirt and debris over time requiring constant cleaning. Also, a curved ditch is incapable of handling as large of volume of water as a flat bottomed ditch of the same width. In additional, the velocity of water flowing through a conventional curved ditch is significantly higher than a flat bottomed ditch of the same width thereby increasing erosion of the land.

Examples of ditch diggers include U.S. Pat. No. 5,113,610 to Liebrecht, Jr.; U.S. Pat. No. 2,965,985 to Sillasen; U.S. Pat. No. 5,237,761 to Nadeau; U.S. Pat. No. 3,624,826 to Rogers; U.S. Pat. No. 3,025,618 to Croucher; U.S. Pat. No. 2,923,073 to Baker; U.S. Pat. No. 2,885,800 to Hawkins; U.S. Pat. No. 1,175,926 to Bunnell; U.S. Pat. No. 1,095,097 to Foumet; U.S. Pat. No. 5,027,534 to Sackett; U.S. Pat. No. 16,007 to Evans which are all illustrative of such prior art.

Liebrecht, Jr. (U.S. Pat. No. 5,113,610) discloses a rotating disk type ditcher. Liebrecht teaches a frame structure, a PTO power system, and a cutting disk inclined downwardly so that the leading edge cuts into the ground. A plurality of paddles or scoops are positioned on the back side of the disk that throw the soil particles.

Sillasen (U.S. Pat. No. 2,965,985) discloses a rotary whirling ditcher. Sillasen teaches a frame, a drive assembly, and a plurality of rotating blades.

Nadeau (U.S. Pat. No. 5,237,761) discloses a rotary ditcher having ripper blades. Nadeau teaches a flywheel type rotor carrying impeller blades that pickup and throw soil to the side of the rotor, and two ripper blades in front of the rotor that loosen the soil.

While these devices may be suitable for the particular purpose to which they address, they are not as suitable for easily digging ditches, cleaning ditches, and creating terraces with reduced power take-off (PTO) power. Conventional machines require extensive PTO power for operating properly which can be extremely demanding upon a tractor vehicle.

In these respects, the ditch digging and cleaning system according to the present invention substantially departs from the conventional concepts and designs of the prior art, and in so doing provides an apparatus primarily developed for the purpose of easily digging ditches, cleaning ditches, and creating terraces with reduced power take-off (PTO) power.

SUMMARY OF THE INVENTION

In view of the foregoing disadvantages inherent in the known types of ditch diggers now present in the prior art, the present invention provides a new ditch digging and cleaning system construction wherein the same can be utilized for easily digging ditches, cleaning ditches, and creating terraces with reduced power take-off (PTO) power.

The general purpose of the present invention, which will be described subsequently in greater detail, is to provide a new ditch digging and cleaning system that has many of the advantages of the ditch diggers mentioned heretofore and many novel features that result in a new ditch digging and cleaning system which is not anticipated, rendered obvious, suggested, or even implied by any of the prior art ditch diggers, either alone or in any combination thereof.

To attain this, the present invention generally comprises a frame having a hitch and a pair of support arms with wheels, a front blade, a pair of side blades, a dispersing member rotatably attached to the frame, a power train mechanically connected to the dispersing member, and an adjustable deflector assembly attached to the rear portion of the frame. The dispersing member is comprised of a circular base, and a plurality of fan blades orthogonally attached to an upper surface of the circular base. The dispersing member is juxtaposed behind a pan attached to the front blade. The dispersing member is also less than 45 degrees with respect to the ground surface. The blade preferably is V-shaped for penetrating hardened soil. Coulters may be added in front of the front blade for loosening the ground. In operation, the front blade severs the dirt from the ground surface at a desired depth. The dirt is passed over the pan onto the dispersing member where after the fan blades throw the dirt toward the deflector assembly that guides the dirt in the desired location.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a ditch digging and cleaning system that will overcome the shortcomings of the prior art devices.

Another object is to provide a ditch digging and cleaning system that requires significantly less PTO power than conventional ditch digging devices.

An additional object is to provide a ditch digging and cleaning system that can be utilized to dig ditches, clean ditches or create terraces within a field.

A further object is to provide a ditch digging and cleaning system that creates a flat bottomed ditch thereby reducing the velocity of water flow.

Another object is to provide a ditch digging and cleaning system that can be connected to most tractors.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
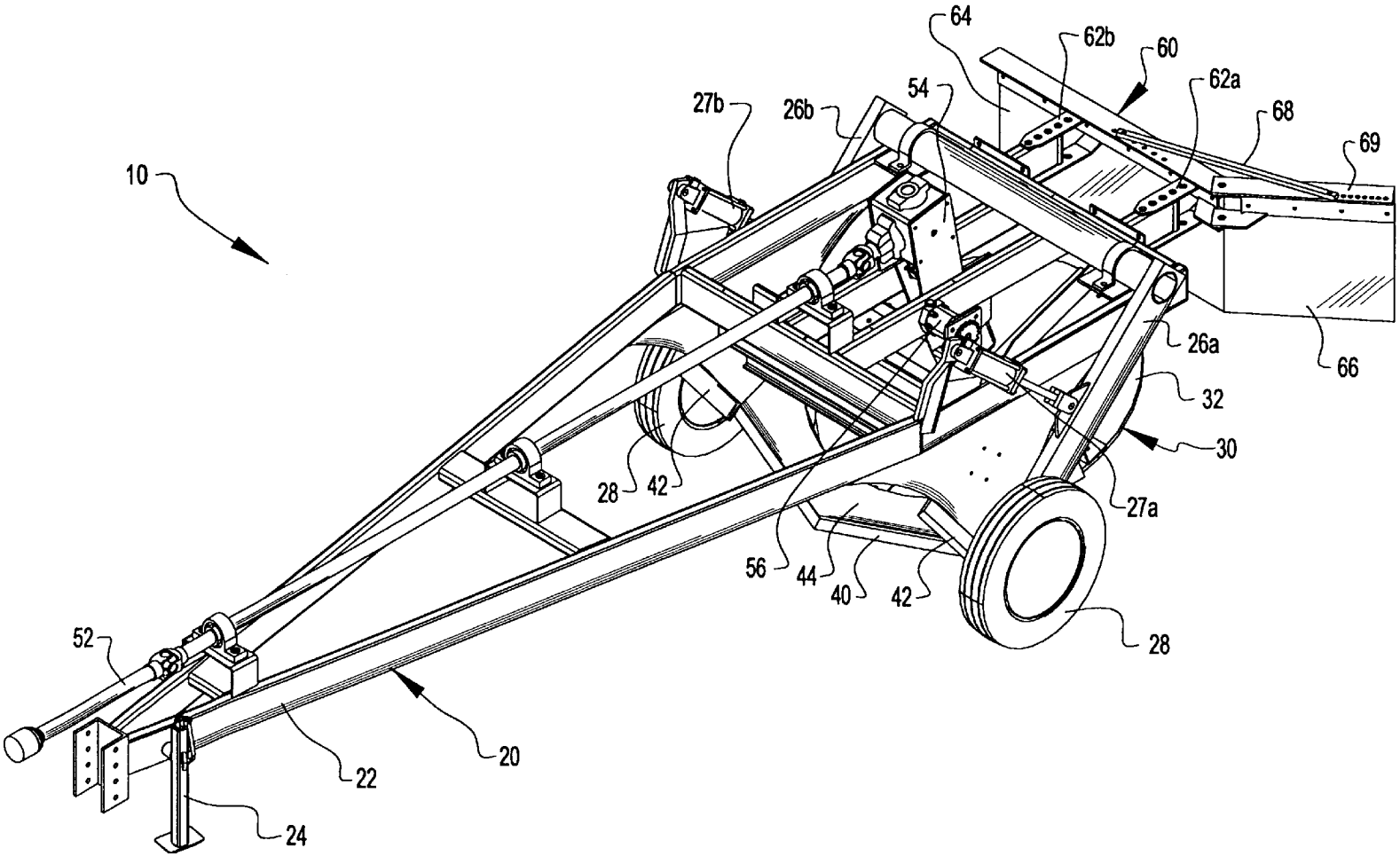
FIG. 1 is an upper perspective view of the present invention.

Turning now descriptively to the drawings, in which similar reference characters denote similar elements throughout the several view, FIGS. 1 through 4 illustrate a ditch digging and cleaning system 10, which comprises a frame 20 having a hitch 22 and a pair of support arms 26*a–b* with wheels 28, a front blade 40, a pair of side blades 42, a dispersing member 30 rotatably attached to the frame 20, a power train 50 mechanically connected to the dispersing member 30, and an adjustable deflector assembly 60 attached to the rear portion of the frame 20. The dispersing member 30 is comprised of a circular base 32, and a plurality of fan blades 34 orthogonally attached to an upper surface of the circular base 32. The dispersing member 30 is juxtaposed behind a pan 44 attached to the front blade 40. The dispersing member 30 is also less than 45 degrees with respect to the ground surface. The blade preferably is V-shaped for penetrating hardened soil. Coulters may be added in front of the front blade 40 for loosening the ground. In operation, the front blade 40 severs the dirt from the ground surface at a desired depth. The dirt is passed over the pan 44 onto the dispersing member 30 where after the fan blades 34 throw the dirt toward the deflector assembly 60 that guides the dirt in the desired location.

Figure 3:
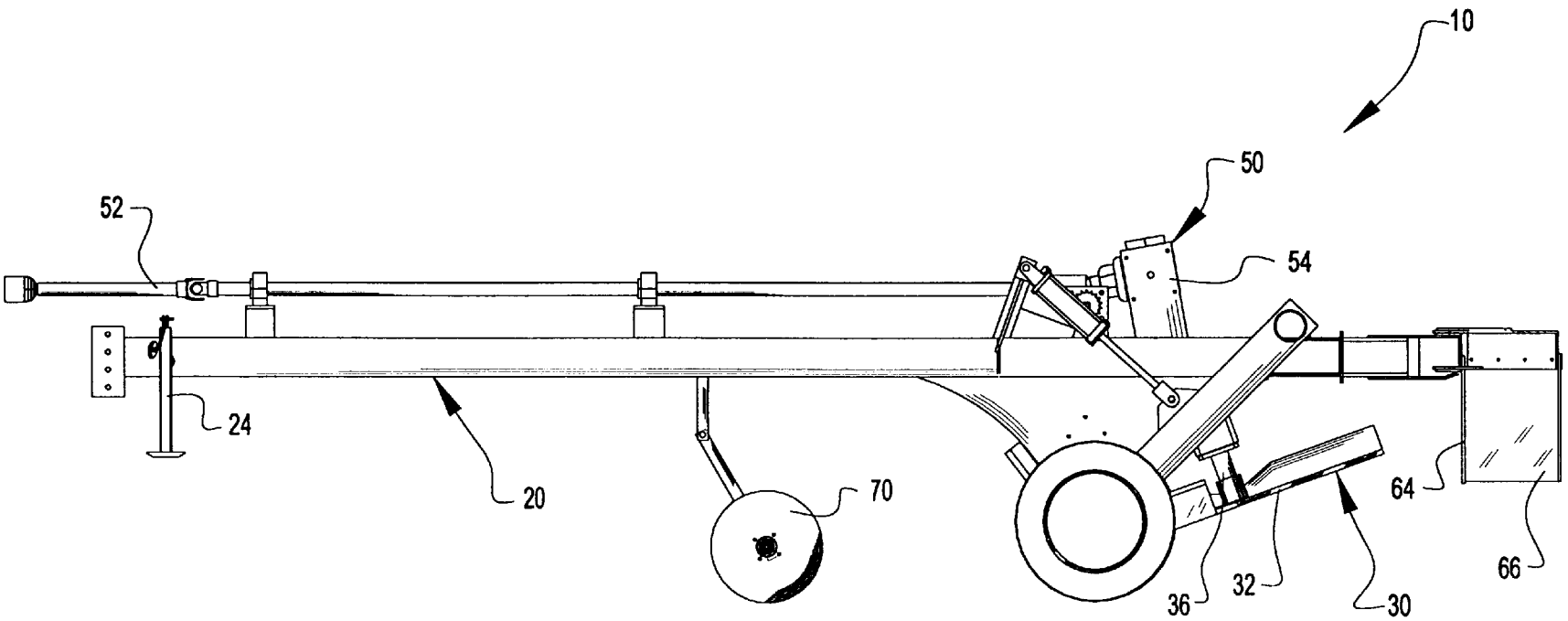
FIG. 3 is a side view of the present invention.
Figure 4:
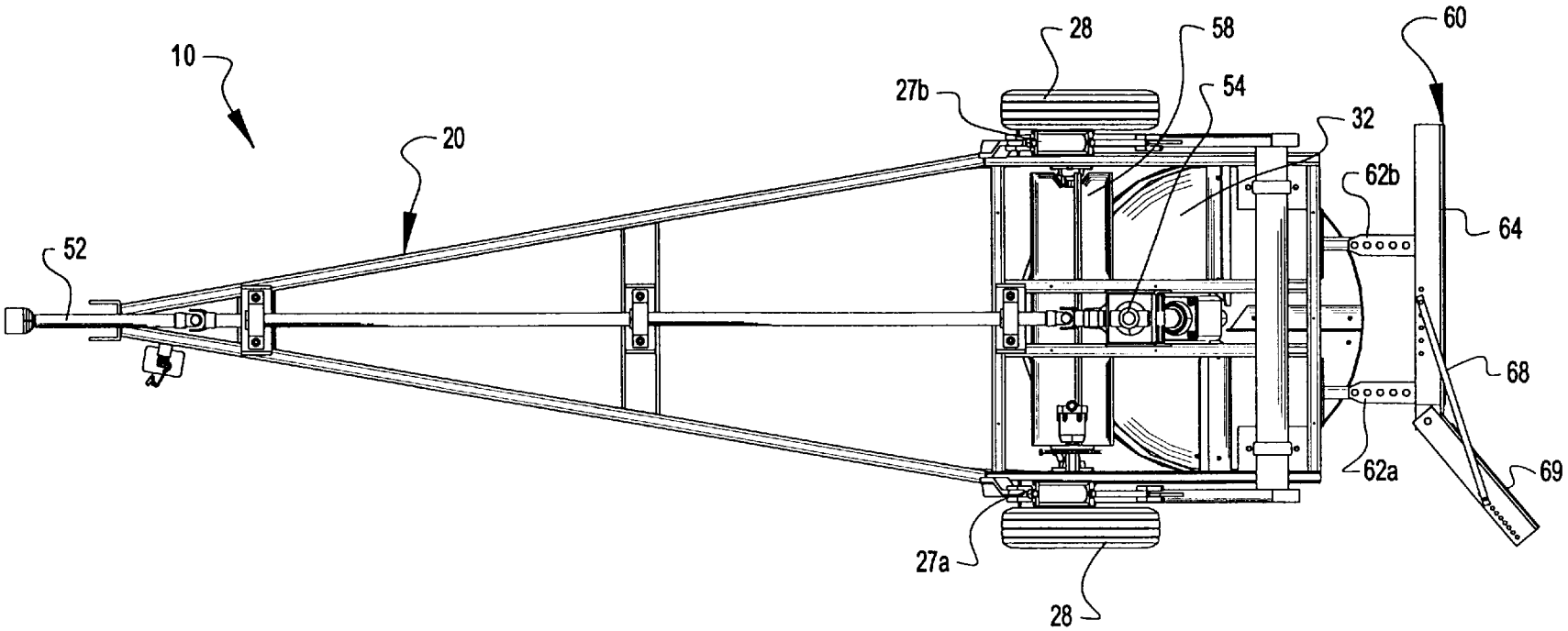
FIG. 4 is a top view of the present invention.

As best shown in FIGS. 1, 3 and 4 of the drawings, the frame 20 includes a hitch 22 for connecting to a tractor vehicle. A jack 24 is attached to the front portion of the hitch 22 for supporting the hitch 22 when not attached to a tractor.

A pair of support arms 26*a–b* are pivotally attached to the rear portion of the frame 20 as shown in FIGS. 1 and 3 of the drawings. The support arms 26*a–b* are preferably angled forwardly as best shown in FIG. 3 of the drawings. A pair of wheels 28 are rotatably attached to the distal ends of the support arms 26*a–b* as shown in FIGS. 1, 3 and 4 of the drawings. A pair of hydraulic cylinders 27*a–b* are connected between the frame 20 and the support arms 26*a–b* for elevating and lowering the frame 20 as best shown in FIG. 3 of the drawings. The hydraulic cylinders 27*a–b* control the depth of the front blade 40. As best shown in FIG. 4 of the drawings, the wheels 28 are positioned outside of the front blade 40 thereby ensuring an even cut through the ground surface.

As shown in FIG. 3 of the drawings, at least one coulter 70 is attached to the frame 20 and extending downwardly in front of the front blade 40. The at least one coulter 70 loosens the ground prior to being engaged by the front blade 40.

Figure 2:
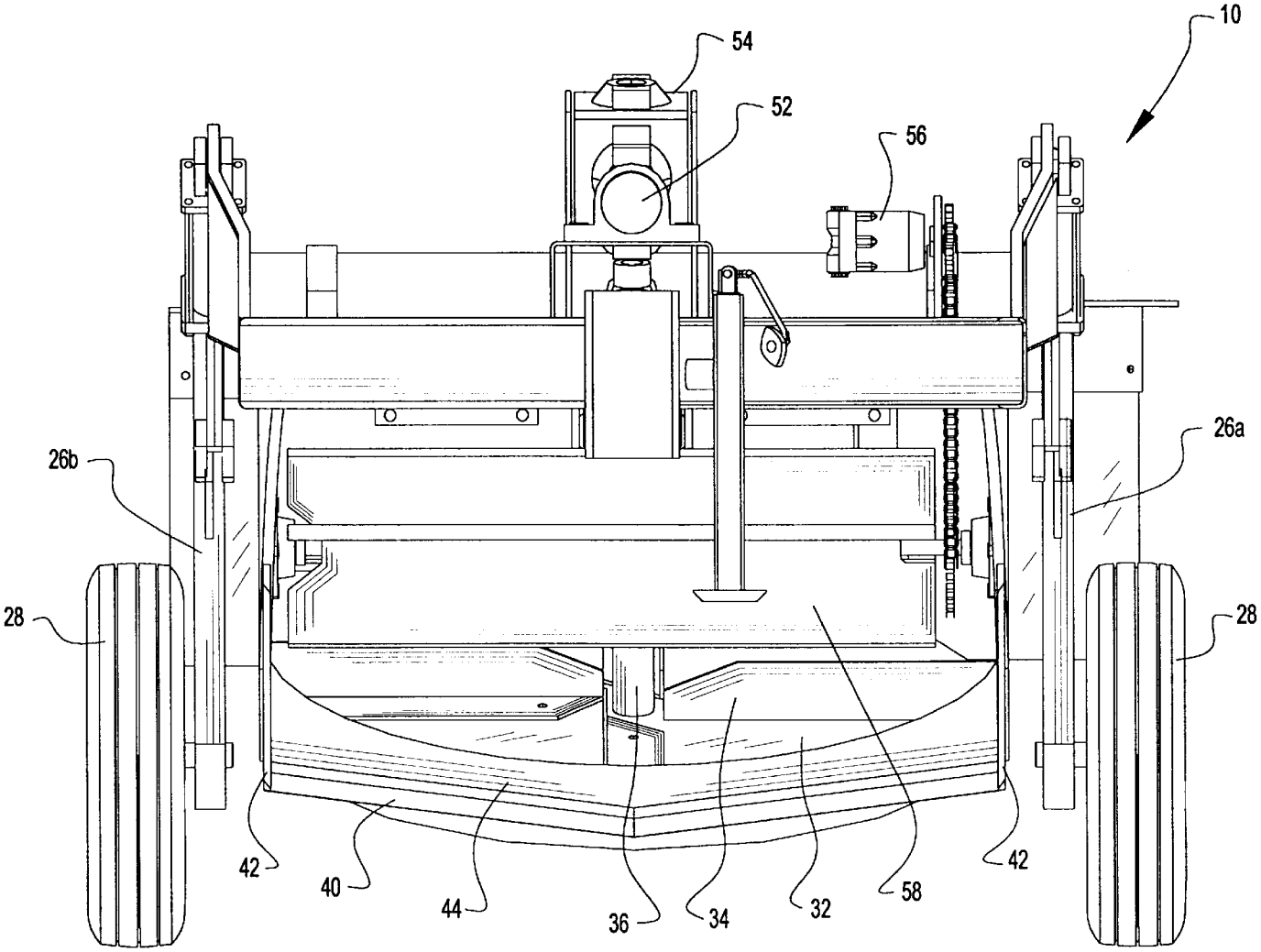
FIG. 2 is a front view of the present invention.

As best shown in FIG. 2 of the drawings, a front blade 40 is attached to the frame 20 along with a pair of side blades 42. The front blade 40 preferably has a V-shape for providing easy penetration into a hardened ground. The front blade 40 is preferably removable and replaceable by another front blade 40 during extend periods of use. The pair of side blades 42 are substantially vertically orientated along the sides of the front blade 40 as shown in FIG. 2 of the drawings. A pan 44 is attached behind the front blade 40 for channeling the newly cut dirt rearwardly. The pan 44 has a semi-circular cutout that receives the dispersing member 30 as best shown in FIG. 1 of the drawings.

As shown in FIGS. 1 through 4 of the drawings, a power train 50 is attached to the frame 20. The power train 50 comprises a PTO shaft 52, a gear box 54, and a drive shaft 36. The PTO shaft 52 is rotatably attached to the frame 20 and is connectable at one end to the PTO of a conventional tractor. The gear box 54 is attached to the opposing end of the PTO shaft 52 for converting the rotational speed downward. The drive shaft 36 is connected to the gear box 54 and to the dispersing member 30 as shown in FIG. 3 of the drawings.

As best shown in FIG. 4 of the drawings, the dispersing member 30 is generally circular in shape. The dispersing member 30 comprises a flat base 32 and a plurality of fan bladed attached to an upper surface of the base 32. The base 32 is circular and has an edge juxtaposed to the semi-circular cutout within the pan 44. The base 32 is lower than the upper surface of the pan 44 thereby allowing the dirt to drop onto the base 32. As best shown in FIG. 3 of the drawings, the base 32 is less than 45 degrees with respect to the ground surface when in operation thereby utilizing little PTO power to elevate the dirt.

The fan blades 34 are preferably attached substantially orthogonally to the upper surface of the base 32. There are preferably four fan blades 34, however it can be appreciated by one skilled in the art than more or less fan blades 34 may be utilized. Some of the fan blades 34 are taller than the other fan blades 34 for providing increased engagement and throwing of the dirt dropped onto the base 32.

As shown in FIGS. 1, 3 and 4 of the drawings, the deflector assembly 60 is attached to the rear portion of the frame 20 for directing the thrown dirt from the dispersing member 30. The deflector assembly 60 is comprised of a pair of adjustable brackets 62*a–b*. A main deflector 64 is attached to the adjustable brackets 62*a–b* as best shown in FIG. 4 of the drawings. An outer deflector 66 is pivotally attached to the main deflector 64 as shown in FIG. 4. The outer deflector 66 includes a plurality of apertures 69 that adjustably receive a locking bar 68 for allowing adjustment of the position of the outer deflector 66.

As best shown in FIG. 2 of the drawings, a beater member 58 is rotatably attached to the frame 20 above the front blade 40. A drive motor 56 is attached to the frame 20 and is mechanically connected to the beater member 58. The drive motor 56 may be comprised of a conventional electric or hydraulic motor as can be appreciated by one skilled in the art. The beater member 58 is comprised of a plurality of paddles that are utilized to push the newly cut dirt downwardly onto the dispersing member 30 as the dirt leaves the pan 44.

In use, the user adjusts the hydraulic cylinders 27*a–b* depending upon the depth desired to cut into the ground surface. The user then engages the PTO thereby causing the dispersing member 30 to rotate behind the front blade 40. The user then operates the conventional tractor pulling the invention forwardly so that the front blade 40 penetrates the ground surface. The newly cut dirt flows upon the pan 44 toward the dispersing member 30 where the beater member 58 engages the dirt pushing it into the dispersing member 30. The dirt falls onto the base 32 where after the fan blades 34 engage the dirt. The fan blades 34 throw the dirt outwardly to the side and rearwardly where the deflector assembly 60 deflects a portion of the thrown dirt into the desired direction. The user may pass over the newly created channel if they desire to dig a deeper channel. If the user desires to create a terrace, the user simply continues passing over the field throwing the dirt in the desired location.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ditch digging and cleaning system, comprising:

a frame;

a power train attached to said frame, wherein said power train is connectable to a conventional tractor;

a front blade attached to said frame, wherein said front blade has an angle with respect to a ground surface of less than 45 degrees for severing and upwardly lifting a portion of ground; and a dispersing member connected to said drive train for rotating said dispersing member and dispersing said portion of ground elevated by said front blade, wherein said dispersing member has a rotational plane less than 45 degrees with respect to said ground surface.

2. The ditch digging and cleaning system of claim 1, wherein said dispersing member a comprises:

a base; and a plurality of blades attached to an upper surface of said base.

3. The ditch digging and cleaning system of claim 2, wherein said base is less than 45 degrees with respect to said ground surface.

4. The ditch digging and cleaning system of claim 2, wherein said base is a flat circular structure.

5. The ditch digging and cleaning system of claim 1, wherein said front blade is V-shaped.

6. The ditch digging and cleaning system of claim 1, including a pair of side blades vertically aligned on the sides of said front blade.

7. The ditch digging and cleaning system of claim 1, including a beater structure for forcing dirt onto said dispersing member.

8. The ditch digging and cleaning system of claim 7, wherein said beater structure comprises:

a drive motor attached to said frame; and a beater member having a plurality of paddles rotatably attached to said frame above said front blade.

9. The ditch digging and cleaning system of claim 1, including at least one coulter attached to said frame in front of said front blade.

10. The ditch digging and cleaning system of claim 9, including a pan behind said front blade, wherein an upper surface of said pan is higher than said dispersing member.

11. A ditch digging and cleaning system, comprising:

a frame;

a power train attached to said frame, wherein said power train is connectable to a conventional tractor;

a front blade having a V-shape attached to said frame wherein said front blade has an angle with respect to a ground surface of less than 45 degrees for severing and upwardly lifting a portion of ground;

a pair of side blades vertically aligned on the sides of said front blade;

a dispersing member connected to said drive train, wherein said dispersing member comprises a base having a flat circular structure and a plurality of blades attached to an upper surface of said base and wherein said base is less than 45 degrees with respect to a ground surface; and a beater structure for forcing dirt onto said dispersing member.

12. The ditch digging and cleaning system of claim 11, wherein said beater structure comprises:

a drive motor attached to said frame; and a beater member having a plurality of paddles rotatably attached to said frame above said front blade.

13. The ditch digging and cleaning system of claim 11, including at least one coulter attached to said frame in front of said front blade.

14. The ditch digging and cleaning system of claim 11, including a pan behind said front blade, wherein an upper surface of said pan is higher than said base.

15. The ditch digging and cleaning system of claim 11, including an adjustable deflector assembly attached to a rear portion of said frame for directing thrown dirt from said dispersing member.

16. The ditch digging and cleaning system of claim 15, wherein said adjustable deflector assembly comprises:

a pair of adjustable brackets attached to said frame;

a main deflector attached to said pair of adjustable brackets; and an outer deflector pivotally attached to said main deflector.

17. A ditch digging and cleaning system, comprising:

a frame;

a power train attached to said frame, wherein said power train is connectable to a conventional tractor;

a front blade attached to said frame having an angle less than 45 degrees with respect to a ground surface for severing and upwardly lifting a portion of ground;

a dispersing member connected to said drive train, wherein said dispersing member has a rotational plane less than 45 degrees with respect to said ground surface and for rotating said dispersing member and dispersing said portion of ground elevated by said front blade; and a beater structure for forcing dirt onto said dispersing member.

18. The ditch digging and cleaning system of claim 17, wherein said dispersing member comprises:

a base; and a plurality of blades attached to an upper surface of said base.

19. The ditch digging and cleaning system of claim 17, wherein said beater structure comprises:

a drive motor attached to said frame; and a beater member having a plurality of paddles rotatably attached to said frame above said front blade.

20. The ditch digging and cleaning system of claim 17, including at least one coulter attached to said frame in front of said front blade.

* * * * *